US005165587A

United States Patent [19]

Marks

[11] Patent Number: 5,165,587

[45] Date of Patent: Nov. 24, 1992

[54] MANUAL STAPLE GUN

[75] Inventor: Joel S. Marks, Los Angeles, Calif.

[73] Assignee: Worktools, Inc., Chatsworth, Calif.

[21] Appl. No.: 772,536

[22] Filed: Oct. 7, 1991

[51] Int. Cl.[5] ..... B25C 5/11

[52] U.S. Cl. ..... 227/132; 227/146

[58] Field of Search ..... 227/132, 146

[56] References Cited

U.S. PATENT DOCUMENTS

| | | | |
|---|---|---|---|
| 1,919,373 | 7/1933 | Krantz . | |
| 2,326,540 | 8/1943 | Krantz . | |
| 2,671,215 | 3/1954 | Abrams . | |
| 2,769,174 | 11/1956 | Libert . | |
| 3,610,505 | 10/1971 | Males | 227/132 X |
| 4,204,622 | 5/1980 | Smith et al. | 227/131 X |
| 4,629,108 | 12/1986 | Judge | 227/132 |
| 4,640,451 | 2/1987 | Steiner et al. | 227/120 X |

FOREIGN PATENT DOCUMENTS

| | | | |
|---|---|---|---|
| 2229129 | 9/1990 | United Kingdom | 227/146 |

*Primary Examiner*—Frank T. Yost
*Assistant Examiner*—Rinaldi Rada
*Attorney, Agent, or Firm*—Poms, Smith, Lande & Rose

[57] ABSTRACT

A manually powered fastening tool which stores and instantly releases the energy of a spring such that it may force a staple type fastener into an object by an impact blow. In the present invention the squeeze handle is hinged near the end of the tool body opposite the end from which the staples exit. The user grips the tool near the staple exit end and pushes the squeeze handle toward the intended staple impact point. This novel arrangement causes the user to force the staple into the receiving object with the same hand that pushes the squeeze handle toward the tool body, while the prior art typically requires use of a second hand to hold the tool firmly upon the staple impact point. Improving from the prior art, the present design ensures that the staple exit end of the tool body will not lift away from the receiving object. The energy storage spring and handle engagement linkage are located remotely from the plunger in the present design. This allows the user to fully grip the tool near the staple exit end of the tool body. The motion of installing a staple with this novel staple gun is therefore similar to the intuitive motion used with a common desk top stapler.

20 Claims, 2 Drawing Sheets

THUMB SIDE
FRONT
BACK
10
12
12
14
15
20
21
22
22
23
24
25
26
30
32
34
36
41
42
51
52
61
83

MANUAL STAPLE GUN

BACKGROUND

1. Field of Invention

This invention relates to manually powered impact stapling and tacking machines.

2. Description of Prior Art

Manually powered impact type stapling and tacking machines are well known. Such devices generally comprise a body, an energy storage spring, a fastener feeding system, a movable operating handle to deflect the energy storage spring, a mechanism to rapidly disengage the handle from the deflected spring, and a sliding plunger linked to the spring to impact the fastener.

The prior art demonstrates numerous means to link the operating handle to the mechanism of the machine. Typically the handle is hinged near the front of the body, front being the end from which the staple exits. To move the handle, the user presses downward and rearward with the palm of the hand. A second configuration has the handle and gripping portion of the tool body reversed so that the handle is pulled upward with the fingers while the palm of the hand presses downward upon the body. Either configuration is limited in utility because of the manner in which the forces must be applied by the operating hand.

By the first arrangement the operating hand must press toward the rear of the tool since leverage is available on the handle only behind the frontwardly mounted handle pivot. Therefore, to effectively install a fastener with this arrangement, a second hand is often required to push on the front of the tool to press the fastener into the installation point.

The second hand also serves to prevent the staple exit end of the tool body from jumping away from the ejecting staple. Efficient one handed operation of such prior art staple guns is not possible. To press down upon the front end, the single operating hand must move closer to the handle pivot point. However, such a position reduces the leverage available to deflect the energizing spring.

Abrams U.S. Pat. No. 2,671,215, attempts to address this issue by placing the handle pivot further toward the front of the body and adding various linkages to enable such a handle to lift the plunger. The extreme forward pivot placement allows for leverage on the handle at a more forward position on the tool body. However, Abrams' design only marginally improves upon the prior art to allow effect one hand operation.

In this configuration, a single hand may both pull the operating handle and push forward on the tool body. But since the operating handle must be pulled by just the finger, the power of the user's arm is not available to compress the energy storage spring in the tool.

Libert U.S. Pat. No. 2,769,174 and Krantz U.S. Pat. No. 2,326,540 approach a solution to the force application issue by placing the operating handle pivot at the rear of the tool body. However, these versions retain the typical front mounted energy storage spring and linkages. The hand grip of the tool must therefore be set back from the front to allow space to accommodate the spring and related linkages. These versions therefore only partially address the issue of efficient force application. The designs of Libert and Krantz do not allow the user's hand to push the handle from a position directly over the exiting staple. Hence they do not fully realize benefits from a rearwardly hinged handle design.

SUMMARY OF THE INVENTION

In the present invention, the hand grip extends to the front end of the tool body. This improvement is possible because of a novel arrangement which locates the spring and related linkages remotely from the plunger. The operating handle can extend the full length of the body and the body can now be effectively gripped up to the extreme front end of the handle. Unlike the prior art, the present design fully exploits the advantage of the rearwardly hinged handle since the user can essentially push out the staple in a motion similar to operation of a common desk top stapler.

In manual staple guns, the energy available to drive a staple is directly proportional to the linear travel of the gripping hand and the force applied to the operating handle. The present design allows placing the hand grip further from the hinge, serving to optimize the motion of the operating handle. This allows the angular change of the handle to be reduced so that the hand remains more nearly parallel to the tool body. A more comfortable hand motion results. This is a further advantage over the prior art.

Because hand force is applied more efficiently in the present invention, a lighter energy storage spring may be used to and provide deeper fastener penetration than is achieved by one hand gripping the tools of the prior art.

Staple guns of the prior art have utilized housings of stamped steel or injection molded plastic. To improve the shock damping characteristics of stapling machines one embodiment of the present invention uses a die cast zinc housing. Die cast zinc contains the further benefit of long lasting integral guiding and bearing surfaces.

It is an object of the present invention to improve the hand motion required to operate a manual staple gun such that less apparent effort will product an equal or greater stapling effect compared to the prior art.

It is a further object of the present invention to provide a design in which a force upon the operating handle of a stapling machine will maximally bias the tool body toward the object to be fastened.

It is a further object of the present invention to provide a stapling machine which is optimized for one handed operation.

It is a further object of the present invention to provide an impact type manual staple gun wherein the operating motion is similar to that of a common desk top stapler.

It is a further object of the present invention to provide for gripping of a manual staple gun at the end of the tool from which the staple exits.

It is a further object of the present invention to provide for an operating motion of a manual staple gun that is more comfortable than the prior art.

It is a further object of the present invention to provide a manual staple gun that operates with minimal shock upon staple ejection.

DETAILED DESCRIPTION OF THE ILLUSTRATED EMBODIMENT

Figure 2:
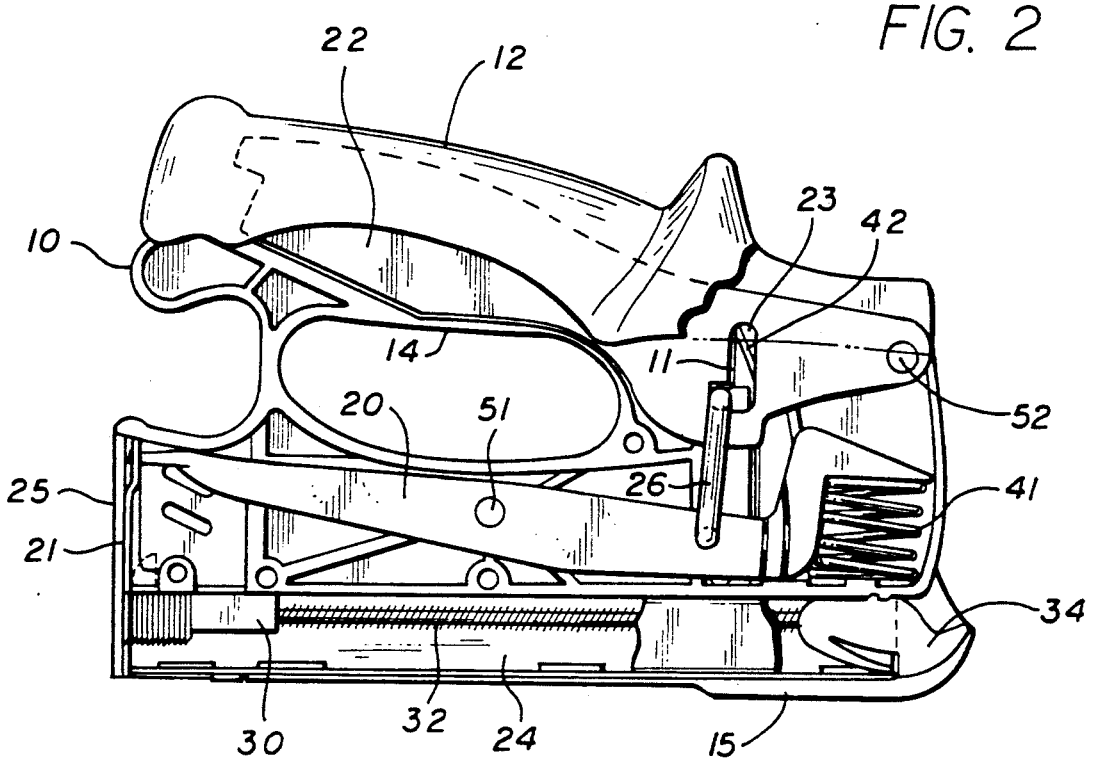
FIG. 2 is a side elevation of the staple gun of FIG. 1, with the grip handle fully drawn toward the tool body and spring energized as the tool would appear just prior to ejection of a staple.

A die-cast metal housing 10 consists of two opposing halves joined together to contain, guide and hold in position the functional components of the tool. Opening 14 is provided to receive the fingers of a gripping hand. The hand rests upon molded handle cover 12 such that the thumb faces away from pivot 52. Handle cover 12 fits over squeeze lever 22. A force transmitting lever 20 pivots about pin 51 to transfer the force generated by spring 41 to staple ejection plunger 21. As squeeze lever 22 is drawn toward housing 10 by pressing downward on the portion of squeeze lever 22 above staple ejection plunger 21. Engagement linkage 26 transfers the squeeze lever motion to the transmitting lever 20 because of the position of linkage 26 in slot 23 of the squeeze lever. As squeeze lever 22 approaches the end of its inward or downward stroke and the thumb side of squeeze lever 22 approaches staple ejection plunger 21, linkage 26 becomes unstable within its position in the short leg of slot 23 because of the geometry of slot 23. Linkage 26 is prevented from sliding within slot 23 toward lever pivot 52 by steel guide 11, which protrudes from the inside of zinc housing 10 and slidably contacts the end of linkage 26 within slot 23. Guide 11 is visible in FIG. 2. At the extreme end of the stroke of the squeeze lever, unstable linkage 26 slides down past guide 11 and passes to the other side (the right hand side as seen in FIG. 2) of the guide 11 and into the long leg of slot 23. The end of linkage 26 within slot 23 is then free to travel within the long leg of slot 23 until it is near the end of slot 23 opposite the initial position of the linkage 26. Spring 41 which has been compressed by the motion of force transmitting lever 20 is free to expand, driving linkage 26 upwards within slot 23, and simultaneously driving plunger 21 downwards by pivoting force transmitting lever 20 about pivot 51. At this point the components are in the configuration shown in FIG. 3.

Figure 1:
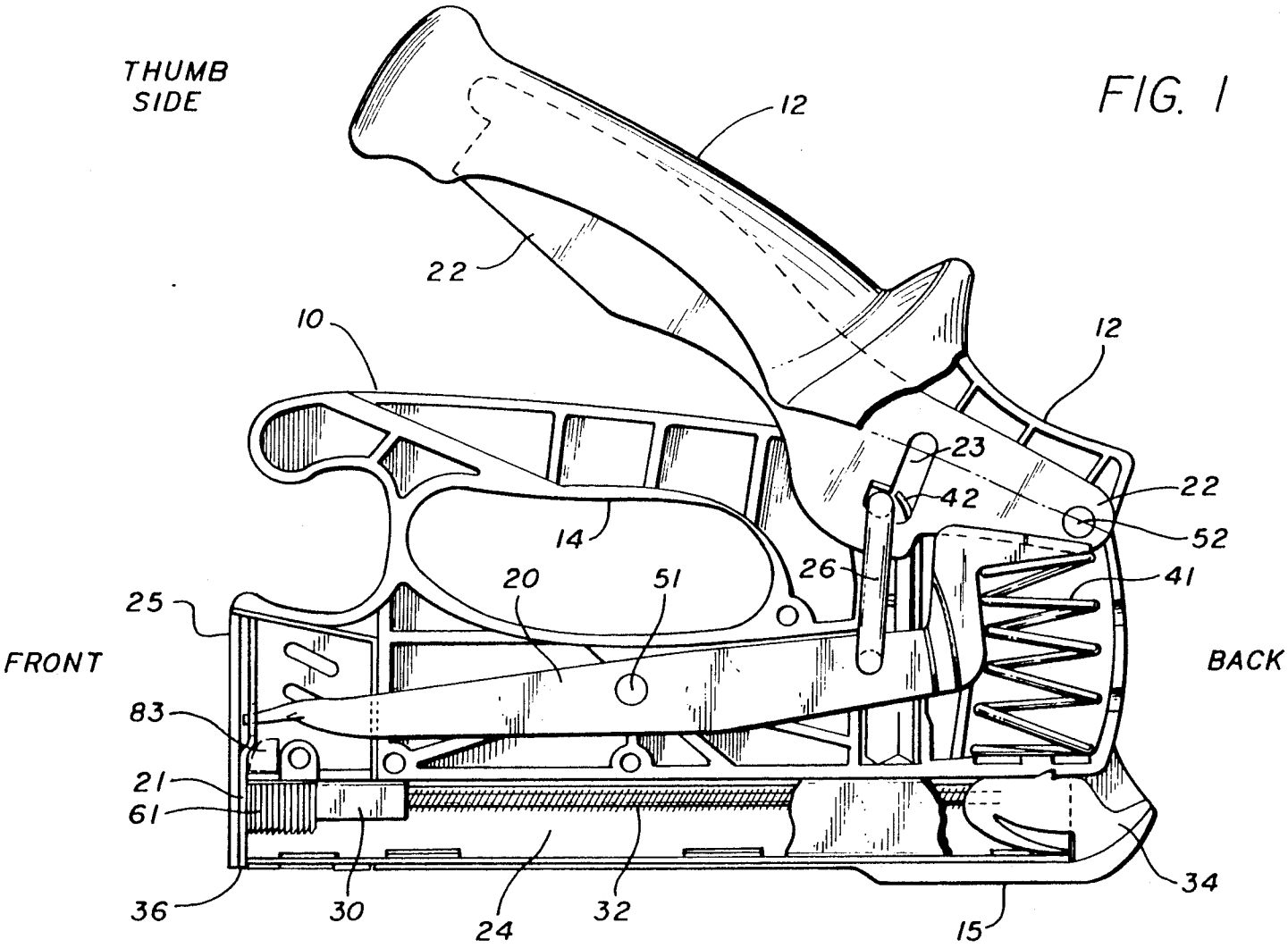
FIG. 1 is a side elevation, partly in section, of a staple gun constructed according to one embodiment of the invention, with its grip handle in an extended position and energizing spring in its rest state, as the tool would appear before commencing an operating sequence.

As spring 41 is compressed, the end of force transmitting lever 20 opposite spring 41 raises staple ejection plunger 21 to admit a staple 61 into ejection chamber 36. Staples 61 are biased toward the plunger by spring loaded assembly 30 and 32. Plunger 21 is configured with an offset such that the section where plunger 21 and force transmitting lever 20 engage each other is in a plane substantially parallel to the plane occupied by the portion of plunger 21 within ejection chamber 36 when the staple gun is not in use, as shown in FIG. 1. With this design, a protruding portion of nose piece 25 to accommodate a connection of lever 20 to plunger 21 is unneeded.

Molded end piece 34 holds spring loaded assembly 30 and 32 inside one piece staple feeding channel 24. End piece 34 is a one piece component. It is protected at the end opposite spring loaded assembly 30 and 32 by protrusion 15.

Figure 3:
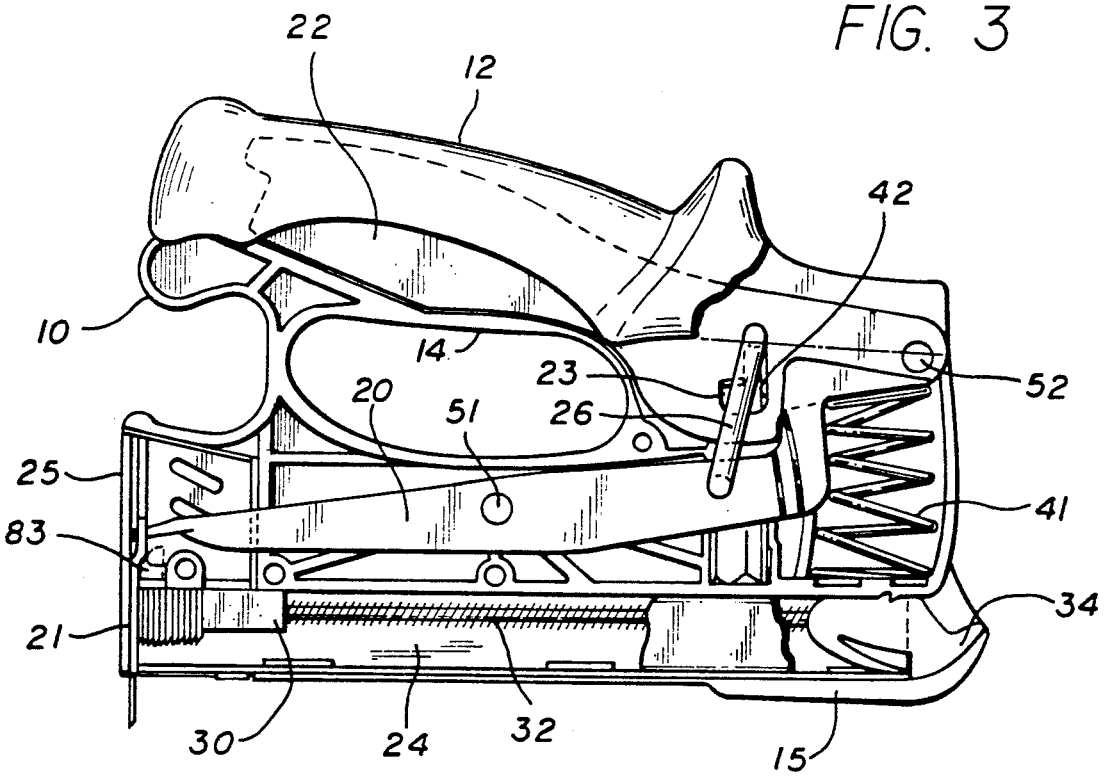
FIG. 3 is a side elevation of the staple gun of FIG. 1, with the spring in its rest state and the handle fully drawn toward the tool body, as the tool would appear just after ejection of a staple.

A shock absorbing member 83 is provided in a preferred embodiment to arrest or dampen the motion of lever 20 as it drives a staple through ejection chamber 36, as shown in FIG. 3.

As squeeze lever 22 is released to its extended position, linkage 26 is biased away from pivot 52 by spring 42 so that linkage 26 returns to its rest position within the short leg of slot 23.

Suitable fasteners, not shown, are provided to secure housing halves 10 together (one half is not shown). Housing protrusion 15 contacts the plane of the surface into which the staple is inserted. By this arrangement the tool of the present invention contacts the surface being fastened only at the staple insertion point and at protrusion 15. Therefore the staple insertion point will not be held off the fastening surface by small irregularities in the surface.

There has been described hereinabove a novel staple gun. Those practiced in the art may make variations of the above invention without departing from the inventive scope which is determined solely by the following claims.

What is claimed is:

1. A fastening tool comprising:

a housing;

a first lever pivoted within and essentially along the length of said housing, and having first and second ends;

a plunger oriented to engage fasteners in order to expel them from said housing, said plunger pivotally connected to said first lever near the first end thereof;

a second lever pivoted with respect to said housing at a first end;

linking means releasably connecting said first lever to said second lever, said linking means having a first position such that movement of said second lever towards said housing is transferred to said first lever near the second end thereof, and a second position such that said first lever and said second lever are free to move independently of each other;

said linking means further comprising an L shaped slot in said second lever having short and long legs, said slot slidably receiving a linking member connecting motion of said second lever to said first lever, said first position of said linkage means being when said linking member occupies the short leg of said L shaped slot, said second position being when said linking member occupies the long leg of said L shaped slot, said slot enabling rapid de-linkage of the first lever from the second lever near a particular angular position of the second lever relative to said housing;

a first spring located adjacent to said first lever such that said first spring is deflected from its rest state as said second lever is moved towards said housing;

a release point of said linking means which causes said linking means to move from said first position to said second position, said release point located at a point such that said second end of said second lever is substantially adjacent to said housing, release of said linking means allowing said first spring to return to its rest state;

a channel through which fasteners are fed, said plunger raised above said channel sufficiently to permit a fastener to move beneath said plunger when said second end of said second lever is nearly substantially adjacent to said housing while said linking means is in said first position, said plunger forced through said channel by said first lever and said first spring once said linking means moves form said first position to said second position;

said plunger defining a plane of motion of said plunger as said plunger is alternately raised and lowered;

a hand grip opening comprising a region substantially immediately adjacent to and/or above said plunger.

2. The tool of claim 1, in which said hand grip opening comprises a region passing through the plane of motion of said plunger as said plunger is alternately raised and lowered, said hand grip opening located immediately above said plunger.

3. The tool of claim 1, in which said first spring is located towards the second end of said first lever and said plunger is located towards the first end of first lever;

said first lever pivoting about a point located substantially at the midpoint between said first end and said second end of said first lever.

4. The tool of claim 1, in which said second lever rotates about a pivot which is located at one end of the length of said housing, such end being at the opposite end from said plunger.

5. The tool of claim 1, in which said second lever contains an L shaped slot through its thinnest dimension, wherein the slot slidably receives a linking member to link motion of the second lever to said first lever, such slot further enabling rapid delinkage of the first lever from the second lever at a specific angular position of the second lever relative to said housing.

6. A fastening tool in which force is applied to a lever arm to store and instantly release the energy of a spring to drive fasteners into an object by an impact blow;

a plunger which is alternately raised and lowered defining a plane of motion of said plunger, said plunger positioned such that when said lever arm is near the maximum displacement from its rest position, the direction of said force applied to said lever arm is essentially parallel to the plane of motion created by the alternate raising and lowering of said plunger, and said force is applied to said lever arm from a position substantially immediately above said plunger;

a front outside surface forming a recess at the front of said fastening tool extending towards the back of said fastening tool to define a hand grip opening so as to accommodate the hand of a user.

7. The tool of claim 6, in which said spring is preloaded when in its resting position, and in which movement of said plunger comprises movement of minimal reciprocating mass relative to the total weight of the tool.

8. A fastening tool comprising:

a housing having a front, back, top, bottom, and first and second sides;

a fastener channel having a top, bottom, front, and rear, located in said housing, near the bottom of said housing, said front of said fastener channel located at the front of said housing, the bottom of said fastener channel located adjacent to/coincident with the bottom of said housing, said fastener channel guiding fasteners towards the front of said housing;

a first opening in said fastener channel within said housing located in the bottom of said fastener channel and said housing, near the front of said fastener channel and said housing;

a second opening in said fastener channel within said housing located in the top of said fastener channel, substantially immediately above said first opening in said fastener channel and said housing;

a plunger located towards the front of said housing, said plunger having a top and bottom portion, said bottom portion of said plunger located within said first and second opening in said fastener channel in an initial configuration, and oriented to expel objects within said fastener channel out of said first opening in said fastener channel when said plunger is alternately raised towards the top of said housing and lowered towards the bottom of said housing;

a plunger channel located substantially immediately above said second opening in said fastener channel for guiding said plunger as said plunger is alternately raised and lowered;

a first lever having first and second ends extending from the front of said housing toward the back of said housing, connected to said housing by a first pivot, said top of said plunger pivotally connected to said first end of said first lever;

a second lever having first and second ends, said first end positioned above the top of said housing, and located substantially towards the front of said housing, said second end pivotally connected to said housing near the rear portion of said housing;

a first spring member oriented to apply force tending to force said plunger towards said first opening in said fastener channel;

a linkage pivotally fastened to said first lever between the second end of said first lever and the pivotal connection of said first lever and said housing;

said linkage releasably connected to said second lever, said linkage having first and second positions, said first position such that when said second lever is moved towards the top of said housing, said linkage conveys the motion of said second lever to said first lever, loading said first spring member, said second position such that said linkage is free to move independently of said second lever, said linkage releasing from said first lever when the first end of said second lever is near or adjacent to said top of said housing, allowing said first lever to move independently of said second lever.

9. The fastening tool of claim 8 further having a guide positioned near said linkage and said second lever such that said linkage is prevented from releasing from said first position during the downward motion of said second lever until said second lever is substantially adjacent to said top of said housing.

10. The fastening tool of claim 8 further comprising a second spring member oriented to bias said linkage towards said first position of said linkage.

11. The fastening tool of claim 10 wherein said second spring member biases said linkage only when said first end of said second lever is substantially away from said housing.

12. The fastening tool of claim 8 further comprising: a spring loaded means for pushing objects in said fastener channel from the back of said housing towards the front of said housing.

13. The fastening tool of claim 8 wherein said plunger is bent such that the top portion of said plunger occupies a first vertical plane and the bottom portion of said plunger occupies a second plane substantially parallel to said first plane, said second plane separated from said first plane, said second plane located towards the front of said housing with respect to said first plane, allowing the front of said housing to occupy a single plane, substantially parallel to first and second planes, eliminating the need for the housing to extend beyond the second plane in order to accommodate the pivotal connection of said plunger and said first end of said first lever.

14. The fastening tool of claim 8 wherein said first pivot is located substantially at the midpoint between said first and second ends of said first lever, substantially at midpoint between front and back of said housing, and above said fastener channel.

15. The fastening tool of claim 8 in which said first spring member further comprises a spring located towards the second end of said first lever.

16. The fastening tool of claim 8 further having a boot located on the bottom of the housing, near the back thereof, causing the back of said housing to be slightly elevated with respect to the front of said housing when the bottom of said housing is placed against a flat surface.

17. A fastening tool comprising:

a housing having a front, back, top, bottom, and first and second sides;

a fastener channel located in said housing, near the bottom thereof, to guide fasteners towards the front of said housing;

a first opening in said fastener channel, near the bottom, front of said housing;

a plunger located towards the front of said housing, said plunger having a top and bottom portion, and oriented to expel objects in said fastener channel through the first opening therein when said plunger is alternately raised towards the top of said housing and lowered towards the bottom of said housing;

a first spring member oriented to apply downward force, tending to force said plunger towards said first opening in said fastener channel;

a first lever;

a pivot connecting said first lever to said housing, said pivot located in or adjacent to the back of said housing, said first lever releasably linked to said plunger such that by forcing said first lever towards the bottom of said housing, said first spring member is loaded, and said plunger raised towards the top of said housing, said first lever releasing from said plunger when said first lever is near the limit of the range of travel of said first lever in the direction of the bottom of said housing, allowing said first spring member to unload, and said plunger to lower;

a front outside surface forming a recess at the front of said housing extending towards the back of said housing to define a hand grip opening so as to accommodate the hand of a user.

18. The fastening tool of claim 17 wherein said front of said housing occupies a single vertical plane.

19. The fastening tool of claim 17 in which said hand grip opening is located in front of and/or above all movable components except said first lever which is located above said hand grip opening.

20. The fastening tool of claim 17 in which the first and second sides of said housing are die cast and joined together to form said housing.

* * * * *